US006955305B2

(12) United States Patent
Banach

(10) Patent No.: US 6,955,305 B2
(45) Date of Patent: Oct. 18, 2005

(54) WEIGHT FOR DRINKING APPARATUS

(76) Inventor: Wallace Franklin Banach, 6042 Edsall Rd. Apt., 304, Alexandria, VA (US) 22304

( * ) Notice: Subject to any disclaimer, the term of this patent is extended or adjusted under 35 U.S.C. 154(b) by 317 days.

(21) Appl. No.: 10/092,294

(22) Filed: Mar. 7, 2002

(65) Prior Publication Data

US 2002/0088870 A1 Jul. 11, 2002

Related U.S. Application Data

(63) Continuation-in-part of application No. 09/766,599, filed on Jan. 23, 2001, which is a continuation-in-part of application No. 09/670,816, filed on Sep. 28, 2000, now abandoned.

(51) Int. Cl.[7] ..... A47G 21/18
(52) U.S. Cl. ..... 239/33; 222/464.4; 215/229
(58) Field of Search ..... 239/24, 33; 222/464.4; 215/11.1, 11.4, 229, 388, 389; 229/103.1; 220/705, 706; 473/256, 437

(56) References Cited

U.S. PATENT DOCUMENTS

| | | | | | |
|---|---|---|---|---|---|
| 214,617 | A | | 4/1879 | Brown | |
| 942,306 | A | | 12/1909 | Clarke | |
| 1,253,579 | A | | 1/1918 | Deanes | |
| 1,293,850 | A | | 2/1919 | Mathis | |
| 1,309,994 | A | | 7/1919 | McAuliffe | |
| 1,710,163 | A | | 4/1929 | Hartney et al. | |
| 1,735,144 | A | | 11/1929 | Tanner | |
| 1,813,285 | A | | 7/1931 | Galetschky | |
| 1,887,013 | A | | 11/1932 | Coffield | |
| 2,072,580 | A | | 3/1937 | Correll | |
| 2,372,678 | A | | 4/1945 | McKay | |
| 2,530,583 | A | | 11/1950 | Nurkiewicz | |
| 2,613,107 | A | | 10/1952 | Hartnett | |
| 2,613,988 | A | | 10/1952 | Jarbeau | |
| 3,088,680 | A | | 5/1963 | Fulton et al. | |
| 3,099,565 | A | | 7/1963 | Neuhauser | |
| 3,346,133 | A | | 10/1967 | Herdman | |
| 3,411,648 | A | | 11/1968 | Tichy | |
| 3,490,656 | A | | 1/1970 | Taschner | |
| 3,547,296 | A | | 12/1970 | Greenberg | |
| 3,580,430 | A | | 5/1971 | Angele | |
| 3,680,870 | A | * | 8/1972 | Burnett et al. | 473/256 |
| 3,908,690 | A | | 9/1975 | Shotmeyer | |
| 4,273,272 | A | | 6/1981 | Blanc | |
| 4,634,121 | A | * | 1/1987 | Sasaki | 473/457 |
| 4,699,318 | A | | 10/1987 | Donatello et al. | |
| 4,830,235 | A | | 5/1989 | Miller | |
| 5,038,476 | A | | 8/1991 | McCrea | |
| 5,148,971 | A | | 9/1992 | Ahn | |
| 5,195,664 | A | | 3/1993 | Rhea | |
| 5,215,227 | A | | 6/1993 | Farner | |
| 5,636,770 | A | | 6/1997 | Hachinohe | |
| 5,749,814 | A | * | 5/1998 | Chen | 473/437 |
| 5,873,474 | A | | 2/1999 | Gray | |
| 5,934,519 | A | | 8/1999 | Kim et al. | |
| 5,979,715 | A | | 11/1999 | Emrick | |
| 6,056,149 | A | | 5/2000 | Murphy et al. | |
| 6,056,206 | A | | 5/2000 | Whiton | |
| 6,083,116 | A | * | 7/2000 | Loredo | 473/256 |
| 6,264,114 | B1 | * | 7/2001 | Chow | 239/33 |

* cited by examiner

*Primary Examiner*—Steven J. Ganey
(74) *Attorney, Agent, or Firm*—Hall, Myers, Vande Sande & Pequignot

(57) ABSTRACT

A weight for insertion upon a drinking straw which is provided to anchor the drinking straw against the buoyant effects of escaping diffused gases in carbonated drinks.

8 Claims, 5 Drawing Sheets

WEIGHT FOR DRINKING APPARATUS

This application is a Continuation-in-Part of U.S. patent application Ser. No. 09/766,599, filed Jan. 23, 2001, entitled WEIGHTED DRINKING APPARATUS, and invented by Wallace Franklin Banach, which is a Continuation-in-Part of U.S. patent application Ser. No. 09/670,816 filed Sep. 28, 2000now abandoned, entitled WEIGHTED DRINKING APPARATUS AND STORAGE FOR SAME, and invented by Wallace Franklin Banach (now abandoned), the disclosures of which are hereby incorporated by reference.

FIELD OF THE INVENTION

This invention relates to a weight for insertion upon a drinking straw which is provided to anchor the drinking straw against the buoyant effects of escaping diffused gases in carbonated drinks.

BACKGROUND OF THE INVENTION

Certain drinking apparatus are known which are designed to make the consumption of various types of beverages, including carbonated beverages, more convenient. Representative examples of such apparatus are disclosed in U.S. Pat. Nos. 214,617; 1,253,579; 2,613,107; 3,099,565; and 5,038,476. Typically, such drinking apparatus have been used, for example, to automatically "float" a straw (which is enclosed in a drinking container) to the beverage surface for convenient access when the beverage container is opened (such as by removal of a bottle cap, for example). Other examples of known drinking apparatus include straws with integrated spoons, straws with mixing or swirling devices, and straws with check valves for fluid control or regulation.

Although, as evidenced by the above referenced patents, various types of apparatus have been invented in the past to render the process of drinking a beverage through a straw (or other tubular apparatus) more convenient, no known device or system has addressed the problem of the buoyant effect of escaping gases in carbonated beverages. In particular, a typical straw when placed in a carbonated beverage will not remain at the bottom of the glass (or other drinking container) where the beverage is most conveniently and efficiently withdrawn but will float to the surface and, at times, fall out of the glass. Such a floating straw is inconvenient in that its use requires that at least one hand be occupied in holding the straw at the desired location e.g. at the bottom of the glass. In addition, in a highly carbonated beverage, for example, a straw will often float very rapidly to the surface of the beverage and the straw will fall out of the glass causing beverage to spill on the person holding the beverage container, the table, or other surface (e.g. causing stains etc. . . . ).

In view of the above, it is apparent that there exists a need in the art for a drinking apparatus which is capable of anchoring itself against the buoyant effects of escaping gases in drinking beverages. It is a purpose of this invention to fulfill this need in the art, as well as other needs which will become apparent to the skilled artisan once given the following disclosure.

SUMMARY OF THE INVENTION

Generally speaking, this invention fulfills the above-described needs in the art by providing: a weight for anchoring one end of a tubular member at a desired location in a beverage container containing a liquid beverage, the weight comprising:

a weight body having a passage for insertion of a tubular member therethrough, the passage extending through a length of the weight body and including a first and a second aperture;

wherein a portion of the passage has an asymmetrical circumference for frictionally gripping a portion of the tubular member.

IN THE DRAWINGS

Figure 4:
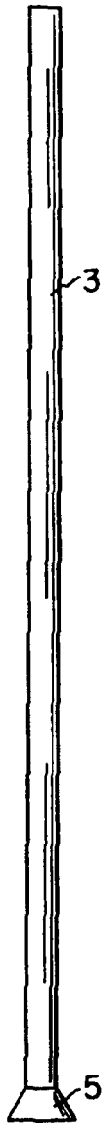
FIG. 4 is a side view of an embodiment of a straw according to the subject invention.
Figure 4A:
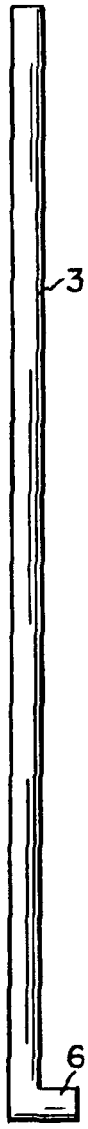

FIG. 4*a* is a side view of an alternative embodiment of a straw according to the subject invention.

Figure 5:
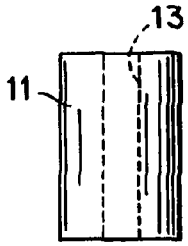
Figure 3:
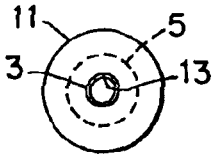
FIG. 3 is a top view of the embodiment illustrated in FIG. 2.

FIG. 5 is a side view of an embodiment of a weight according to the subject invention.

Figure 6:
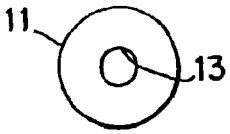

FIG. 6 is a top view of the embodiment illustrated in FIG. 5.

Figure 7:
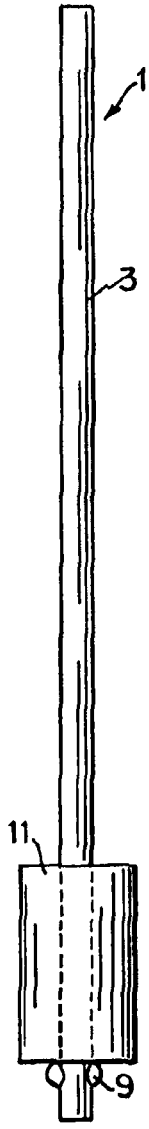

FIG. 7 is a side-view of an alternative embodiment of the drinking apparatus of the present invention.

Figure 8:
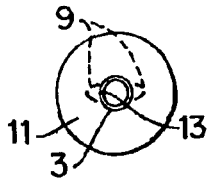

FIG. 8 is a top view of the embodiment illustrated in FIG. 7.

Figure 2:
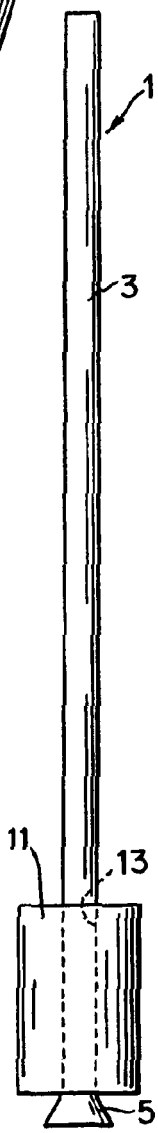
FIG. 2 is a side view of an embodiment of the drinking apparatus of the present invention.
Figure 9:
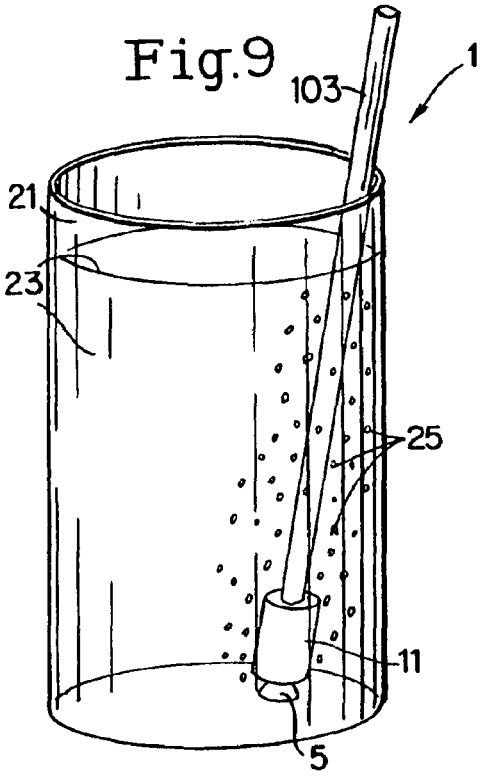

FIG. 9 is a 3-dimensional view of the embodiment of FIG. 2 shown in use in a drinking glass.

Figure 10:
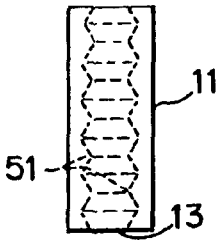

FIG. 10 is a side-plan view of an embodiment of a weight according to the subject invention.

Figure 11:
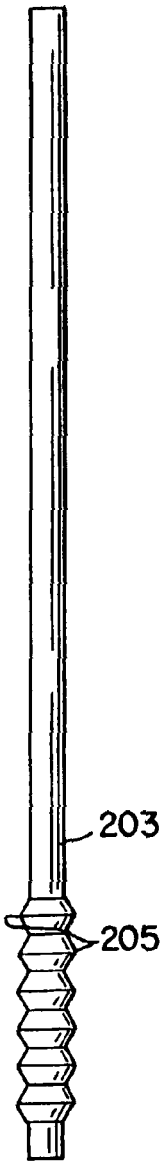

FIG. 11 is a side-plan view of a conventional flex-type straw.

Figure 12:
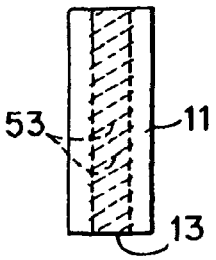

FIG. 12 is a side-plan view of an embodiment of a weight according to the subject invention.

Figure 13:
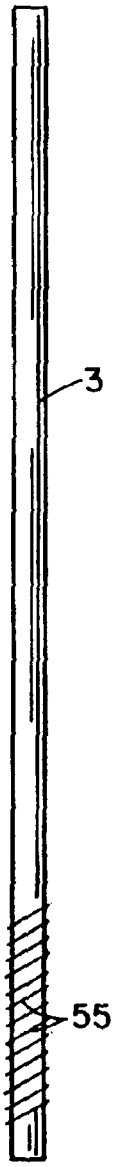

FIG. 13 is a side-plan view of an embodiment of a straw according to the subject invention.

Figure 13A:
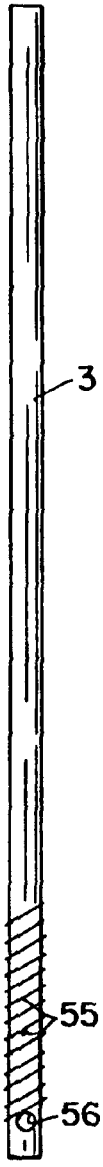

FIG. 13*a* is a side-plan view of an alternative embodiment of FIG. 13.

Figure 14:
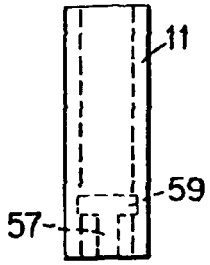

FIG. 14 is a side-plan view of an embodiment of a weight according to the subject invention.

Figure 15:
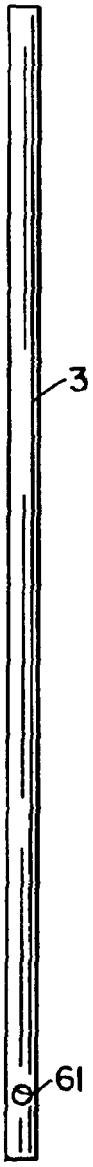

FIG. 15 is a side-plan view of an embodiment of a straw according to the subject invention.

Figure 16:
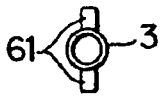

FIG. 16 is a top view of the embodiment of FIG. 15.

Figure 17:
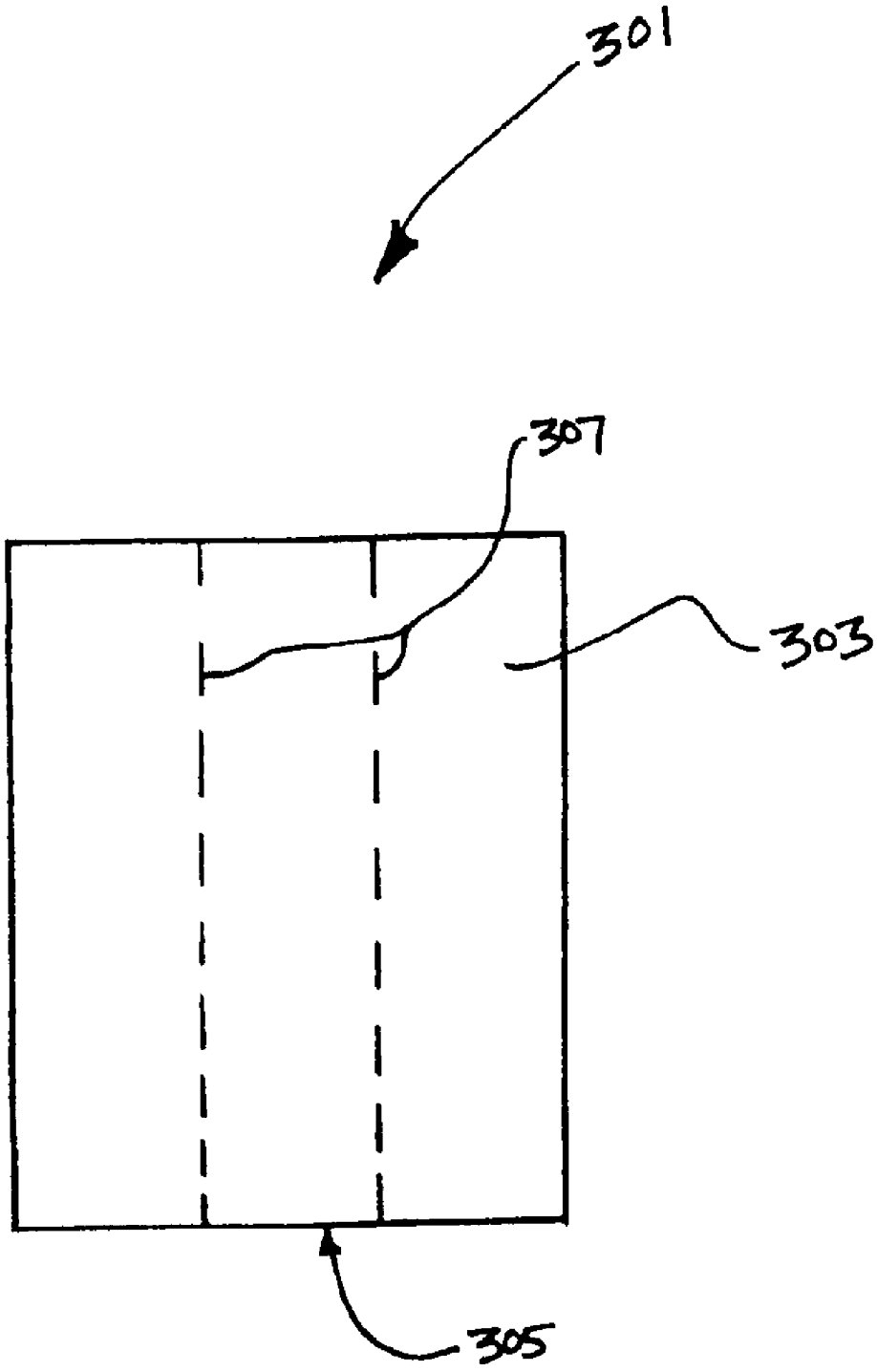

FIG. 17 a side-plan, partial x-ray view of one embodiment of the weight according to the subject invention.

Figure 18:
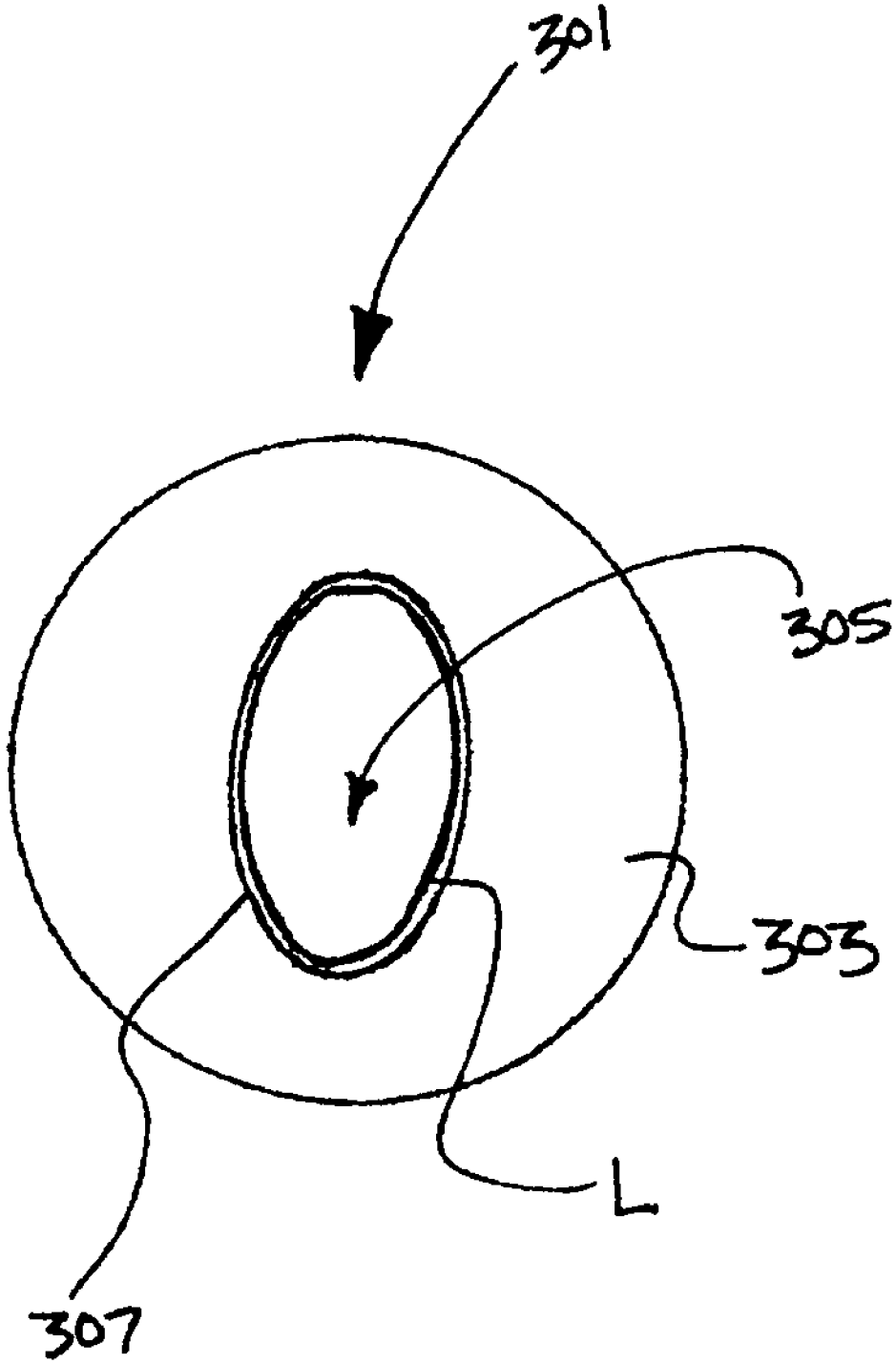

FIG. 18 is a top-plan view of the weight illustrated in FIG. 17.

Figure 19:
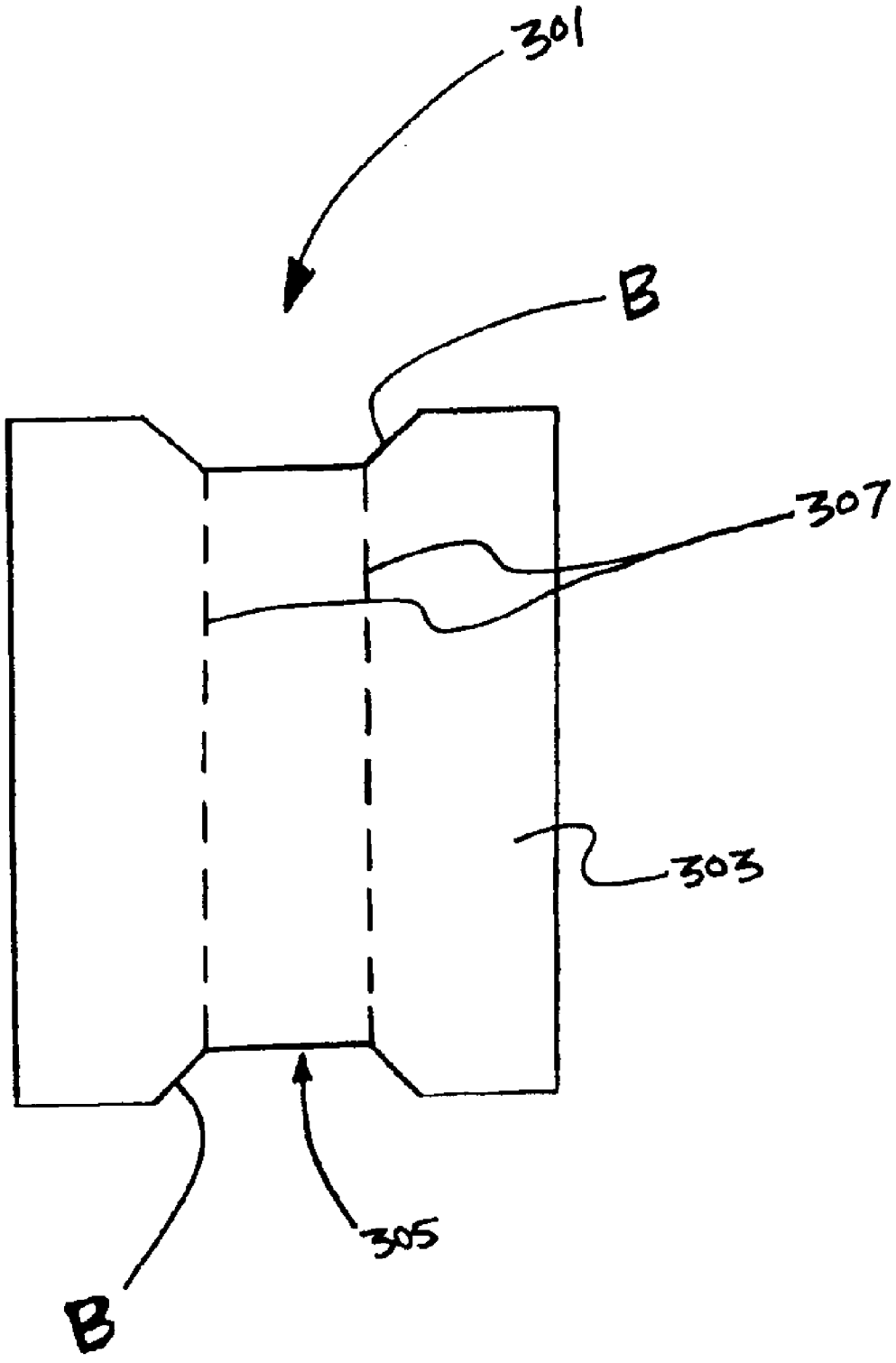

FIG. 19 is a side-plan, partial x-ray view of an alternative embodiment of the weight according to claim 17.

DETAILED DESCRIPTION OF CERTAIN EMBODIMENTS

Figure 1:
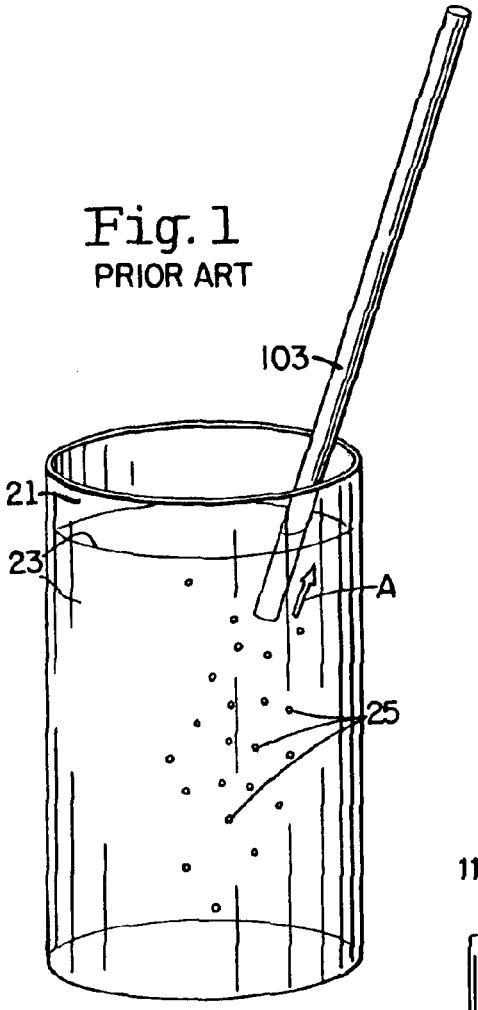
Fig. 1 PRIOR ART
FIG. 1 is a 3-dimensional view of a prior art drinking straw shown in typical known use.

Referring initially to FIG. 1, there is illustrated a prior art straw 103 in typical use in drinking glass 21 filled with carbonated beverage 23. Also illustrated, escaping from beverage 23, are gas bubbles 25 which form as a result of the depressurization of the liquid e.g. when a beverage container is opened. As gas bubbles 25 escape, these bubbles have a cumulative buoyant effect on prior art straw 103 which causes the straw to float upwards from the bottom of the glass in a direction as indicated by arrow "A". This results in straw 103 being inappropriately positioned for ease of use (by a person intending to drink beverage 23). In addition, in some cases, beverage 23 may be so carbonated such that straw 103 is pushed completely out of beverage 23 and glass 21. When this happens, liquid (i.e. beverage 23) is often spilled onto the person drinking from the glass or onto the serving surface (such as onto a serving tray or table). In order to avoid such occurrences when utilizing prior art straw 103, it is necessary for the user of the straw to manually hold straw 103 at the desired location within the drinking glass (e.g. usually at the bottom of the glass).

Referring now to FIGS. 2–9, a solution to the aforementioned prior art problem is therein illustrated. In particular, these figures illustrate weighted drinking apparatus 1 of the present invention. More specifically, weighted drinking apparatus 1 generally includes weight 11 (as shown in both top and profile views in FIGS. 5–6) and straw 3 (or other tubular member suitable for drinking) with flared end 5 which is a diameter that is greater than that of the main portion of the length of straw 3. Weight 11 may be any mass which has a density greater than that of the beverage to be consumed and which includes aperture 13 for insertion of a tubular member therethrough (i.e. straw 3 in the present embodiment). In order to assemble weighted drinking apparatus 1, straw 3 is inserted through aperture 13 of weight 11, and weight 11 is supported about straw 3 by a surface of flared end 5. In order to ensure that weight 11 will be adequately supported, flared end 5 is, of course, greater in diameter than the inside diameter of aperture 13. This area of greater diameter (of flared end 5) is the surface on which weight 11 is supported. In one alternative embodiment of the subject invention illustrated in FIG. 4*a*, straw 3 may simply incorporate a bend in its structure (i.e. an area generally perpendicular to the length of the straw) or series or combination of bends so as to create a surface for weight 11 to rest thereon. Such a surface is exemplified as horizontal portion 6 (FIG. 4*a*) which results from a single bend in straw 3.

In order to thereafter use the unique drinking apparatus of the present invention, weighted drinking apparatus 1 may be inserted in a container (i.e. drinking glass 21) and used to imbibe beverage 23 in a typical manner (as illustrated in FIG. 9). However, as shown in FIG. 9 and unlike straw 103 of the prior art, the mass of weight 11 now anchors straw 3 at a more convenient position at the bottom of the drink container (thus freeing up a hand which would otherwise be used to secure straw 3).

Although straw 3 is illustrated with flared end 5 as a supporting member in the present embodiment, numerous other embodiments of straw 3 are contemplated which are within the scope of the subject invention. In this regard, any embodiment of straw 3 which is capable of retaining weight 11 (or other weight) will serve the purposes of this invention. In some embodiments, straw 3 is simply provided with a portion on its wall (e.g. such as a ridge, or a flap or series of flaps) which protrudes to a distance beyond the outside diameter of straw 3 (and has an effective diameter greater than that of aperture 13) such that weight 11 will be supported thereon. As an example, an embodiment of straw 3 which utilizes an alternative to flared end 5 is illustrated in FIGS. 7 and 8.

Referring now to FIGS. 7 and 8, therein is illustrated two semi-spherical members 9 protruding from the cylindrical wall of straw 3 (shown inserted through weight 11). Specifically, these semi-spherical members 9 each extend a specific distance beyond the outside diameter of the cylindrical outer wall of straw 3 such that these members are capable of retaining weight 11. An example of such a distance is 3/32th of an inch (on each side) on a 1/4 inch diameter straw. This gives the area where semi-spherical members 9 are located an effective diameter of $7/16^{th}$ of an inch. If aperture 13 has an inside diameter of $5/16^{th}$ inch, the $7/16^{th}$ inch effective diameter at semi-spherical members 9 ensures that weight 11 will not fall from the end of straw 3 (i.e. because weight 11 cannot pass a $7/16^{th}$ inch diameter section with only a $5/16^{th}$ inch aperture 13). Although these measurements are illustrative of the general concept of the present invention, they are not meant to be limiting, and any combination of diameters which is effective to retain weight 11 at an appropriate location on straw 3 will suffice.

Although weight 11 is illustrated in a generally cylindrical shape with an aperture through its center, weight 11 may be of any shape or construction which otherwise accomplishes its specific purpose (i.e. to bias straw 3 against the buoyancy forces of the beverage as shown in FIG. 9). An example of such an alternative construction (not shown) includes an inner rubber (or other material) ring for securing weight 11 along the length of straw 3. In such an embodiment, the areas of increased diameter (e.g. flared end 5) on straw 3 are not needed because the friction of the rubber ring secures weight 11 on straw 3. In some preferred embodiments, weights 11 are of ornamental construction (e.g. shaped as an automobile) or contain advertising information such as corporate logos or a proprietor's name, monogram, crest or other identifying information. Although weight 11 may be fashioned in any shape and composed of any safe and non-toxic material which is more dense than the beverage to be consumed, the coefficient of expansion of the material used should be taken into account when determining the size of aperture 13 (so that straw 3 will fit easily therethrough at all normal operating temperatures).

In an alternative embodiment of the subject invention, illustrated in FIG. 10, there is provided a weight 11 with internal "teeth-like" ridges 51 built in to the circumference of its aperture 13 (the ridges comprising both "peaks" and "valleys"). Specifically, these ridges 51 permit weight 11 to be affixed to a conventional flex-type (shown as 203 in FIG. 11) straw without any modification to the straw itself (alternatively however, specifically sized ridges, large or small, may be manufactured into straws where such sized ridges are desirable for effectively engaging with alternatively sized ridges 51). Such a flex-type straw 203 contains an accordion-like flexible structure comprised of ridges 205 (also with "peaks" and "valleys") which allow straw 203 to be bent into various configurations. In particular, ridges 51 of the embodiment of FIG. 10 are complementary to ridges 205 normally found on conventional flex straw 203. Therefore, when the subject embodiment of weight 11 is inserted upon straw 205, the two sets of ridges will match-up (e.g. with a peak resting inside each valley) and effectively secure weight 11 proximal the end of straw 203 (thus enabling it for use as hereinabove described).

Referring now to FIGS. 12 and 13, there is illustrated yet another embodiment of the subject invention. Specifically, FIG. 12 illustrates weight 11 with internal threads 53 within its aperture 13. In this embodiment, straw 3 (FIG. 13) contains threads 55 which are complementary to threads 53 of weight 11. Therefore, in order to secure weight 11 to an appropriate portion of this embodiment of straw 3, weight 11 need only be threaded on to threads 55 (e.g. by inserting straw 3 through aperture 13 and twisting the weight 11 onto threads 55) in order to ready it for use as a weighted drinking system. In one exemplary embodiment illustrated in FIG. 13*a*, stop pin 56 (or a pair of stop pins) may be utilized in order to prevent weight 11 from falling from the bottom end or portion of straw 3 (i.e. the portion of straw 3 inserted into a drink).

In still a further embodiment of the subject invention, straw 3 (FIG. 15) may be provided with locking pins 61 extending from its structure. These pins are designed to fit within specially designed channels 57 built-in to an embodiment of weight 11 illustrated in FIG. 14. Channels 57 extend vertically from the bottom portion of weight 11 until they reach horizontally extending portion or channels 59. When weight 11 is inserted over the tubular structure of the present embodiment of straw 3, weight 11 may be turned so that locking pins 61 match up with vertical channels 57. This will allow locking pins 61 to travel the full vertical length of channels 57 at which point locking pins 61 will be located at the beginning of channels 59. Thereafter, in order to "lock" weight 11 in place on straw 3, weight 11 need only be manually twisted so that locking pins 61 are moved in to place inside the confines of channels 59. Once in place, (this embodiment of) weight 11 will be secured and capable of providing the aforementioned functions herein described in the specification.

In yet a further embodiment of the subject invention illustrated in FIGS. 17–19, there is provided a weight 301 which is capable of being secured to a straw of entirely conventional construction. Such an embodiment saves costs in that specific straw designs need not be employed and thus not manufactured.

As illustrated, weight 301 comprises a weight body 303 having a passage 305 which extends through the length of the weight body. Lending weight 301 its unique properties, passage 305 is shaped, along at least a portion of its length, asymmetrically such that the diameter of the passage is constricted in at least one area of the passage. In certain embodiments, this constriction in the passage resembles an oval in shape, however, other shapes may, of course, be employed. When a straw is inserted in passage 305, then, the asymmetrical portion or constriction in the passage (sized such that its diameter is smaller than that of the straw being employed) effectively grips the walls of the straw and thus retains the weight at the desired location on the straw wall such that the combination may be used to counteract buoyant effects as described with respect to the previous embodiments above. Although various size diameter straws are known in the art, a typical straw diameter is approximately ¼ inch and thus an effective passage diameter i.e. constriction for gripping such a straw is anything sufficiently less than a ¼ inch which renders the weight capable of gripping the straw without unduly restricting beverage flow. An effective constriction size is additionally determined, in part, by the material which comprises the passage and its corresponding coefficient of friction.

In this regard, in certain embodiments, a liner "L" is provided on the interior of asymmetrical circumference 307 to increase the friction between the weight and the straw and thus increase the ability of weight 301 to grip the straw. An exemplar material for such a liner is rubber, however, other materials may, of course, be employed.

In a particularly efficacious embodiment of weight 301, weight body 303 includes an inwardly beveled surface "B" at the perimeter of at least one (or both) of the entrances to passage 305. This beveled surface "B", when employed, renders the insertion of a straw through passage 305 a simpler task by guiding the end of the straw towards the passage entrance via surface B's ramped walls.

Although carbonated beverages are used as an illustrative example herein and tend to be comparatively buoyant, many other types of drinking beverages produce similar buoyancy forces thus resulting in the same prior art problems. As such, applicant does not restrict the use of his invention to that of carbonated beverages.

Once given the above disclosure, many other features, modifications, and improvements will become apparent to the skilled artisan. Such other features, modifications, and improvements are therefore considered to be part of this invention, the scope of which is to be determined by the following claims:

I claim:

1. A weight in combination with a tubular member for anchoring one end of said tubular member at a desired location in a beverage container containing a liquid beverage, said combination comprising:

a weight body having a passage for insertion of said tubular member therethrough, said passage extending through a length of said weight body and including a first and a second aperture;

wherein a first portion of said passage has a circumference having a non-circular constriction therein for frictionally gripping a portion of said tubular member.

2. The combination according to claim 1 wherein said first portion of said passage having said non-circular constriction has a diameter, measured in at least one direction, which is less than a diameter of the tubular member which is to be inserted.

3. The combination according to claim 1 wherein an area of said weight body proximal said first aperture is beveled inwardly towards said first aperture.

4. The combination according to claim 3 wherein an area of said weight body proximal said second aperture is beveled inwardly towards said second aperture.

5. The combination according to claim 3 wherein said passage has a second portion in which said circumference is substantially symmetrical.

6. The combination according to claim 3 wherein said non-circular constriction is substantially oval in shape.

7. The combination according to claim 3 wherein at least a portion of said passage is lined with a friction increasing material.

8. The combination according to claim 3 wherein said first portion of said passage having said non-circular constriction has a diameter, measured in at least one direction, which is less than ¼ inch.

* * * * *